US006708910B2

(12) United States Patent
Moore, Jr.

(10) Patent No.: US 6,708,910 B2
(45) Date of Patent: Mar. 23, 2004

(54) PUMP AND GRINDER ASSEMBLY FOR USE WITH A STEAM PRODUCING DEVICE

(75) Inventor: Roger R. Moore, Jr., Brandon, MS (US)

(73) Assignee: Delaware Capital Formation, Inc., Wilmington, DE (US)

( * ) Notice: Subject to any disclaimer, the term of this patent is extended or adjusted under 35 U.S.C. 154(b) by 27 days.

(21) Appl. No.: 10/144,388

(22) Filed: May 11, 2002

(65) Prior Publication Data

US 2003/0209616 A1 Nov. 13, 2003

(51) Int. Cl.[7] ..... B02C 23/38

(52) U.S. Cl. ..... 241/46.11; 241/46.01; 241/46.17

(58) Field of Search ..... 241/46.01, 46.02, 241/46.08, 46.11, 46.17, 188.1, 191; 60/657

(56) References Cited

U.S. PATENT DOCUMENTS

| | | | | | |
|---|---|---|---|---|---|
| 3,417,929 | A | * | 12/1968 | Secrest | 241/46.04 |
| 3,565,350 | A | * | 2/1971 | Combs et al. | 241/43 |
| 3,591,095 | A | * | 7/1971 | Di Stefano | 241/41 |
| 3,650,481 | A | * | 3/1972 | Conery et al. | 241/46.11 |
| 3,726,486 | A | * | 4/1973 | Smith et al. | 241/46.11 |
| 3,807,644 | A | | 4/1974 | Van Ee | 241/46.08 |
| 3,866,841 | A | * | 2/1975 | Iwahara | 241/46.11 |
| 3,938,744 | A | * | 2/1976 | Allen | 241/46.11 |
| 3,942,729 | A | | 3/1976 | Fredriksson | 241/38 |
| 3,961,758 | A | * | 6/1976 | Morgan | 241/46.11 |
| 3,973,866 | A | * | 8/1976 | Vaughan | 415/121.1 |
| 4,050,636 | A | | 9/1977 | Possell et al. | 241/46 |
| 4,454,993 | A | * | 6/1984 | Shibata et al. | 241/46.017 |
| 4,819,885 | A | | 4/1989 | Wiley | 241/39 |
| 5,000,823 | A | | 3/1991 | Lindahl | 162/28 |
| 5,337,966 | A | * | 8/1994 | Francis et al. | 241/46.06 |
| 5,366,168 | A | | 11/1994 | Dymarkowski | 241/101.7 |
| 5,368,008 | A | | 11/1994 | Oslin | 126/20.2 |
| 5,823,672 | A | | 10/1998 | Barker | 366/205 |
| 5,875,979 | A | | 3/1999 | Walters et al. | 241/79.3 |
| 6,076,754 | A | | 6/2000 | Kesig et al. | 241/101.2 |

* cited by examiner

*Primary Examiner*—William Hong
(74) *Attorney, Agent, or Firm*—Butler, Snow, O'Mara, Stevens & Cannada

(57) ABSTRACT

A pump and grinder assembly is provided for use with a steam producing device having a housing defining a water chamber. The assembly includes a motor having a rotatable output shaft and a pump and grinder shaft coupled to the output shaft for rotation therewith. A blade assembly, having a plurality of blades, is secured to the pump and grinder shaft for rotation therewith. A housing is interconnected to a stationary portion of the motor and defines a grinding chamber housing the blades therein. The assembly is mountable on a steam producing device so that the grinding chamber communicates with the water chamber of the steam producing device. The pump and grinder assembly is operatively effective for pumping water and loose scale contained within the water out of the steam producing device and grinding the scale into relatively smaller pieces.

26 Claims, 9 Drawing Sheets

PUMP AND GRINDER ASSEMBLY FOR USE WITH A STEAM PRODUCING DEVICE

BACKGROUND 1.0 Field of the Invention

The present invention is directed to pump and grinder assemblies and, more particularly, to a pump and grinder assembly for use with a steam producing device, with the pump and grinder assembly being effective for pumping scale out of the steam producing device and grinding the scale into relatively smaller pieces.

2.0 Related Art

Steam producing devices such as steam generators, boilers, coffee makers and others, are well known in the art. Steam generators, which are vented to atmosphere, and boilers, which are pressurized to various gauge pressures, have a variety of applications including multiple applications in the cooking industry. For instance, steam generators and boilers are commonly used with convection-type steamer ovens such as those used in restaurants and other commercial establishments. The water supplied to these steam producing devices typically contains various minerals such as calcium, sodium, iron and magnesium. When the water is heated to its boiling temperature, the molecular bonds of the water break down causing these minerals to be deposited upon various interior surfaces of the housing of the steam producing device and components, such as water level sensors, disposed at least partially within the steam producing device. The minerals are typically deposited on any surface which is exposed to boiling water or steam, which constitutes essentially all interior surfaces of steam generators and boilers. The mineral deposits are referred to herein generically as "scale". The buildup of scale within the steam producing device has a variety of adverse effects including increased operating costs and possible failure of the steam producing device.

Gas-fired steam producing devices typically include an outer housing and a firetube assembly contained within the outer housing. During operation, water is disposed in the space between the outer housing and the firetube assembly. Buildup of scale on the exterior walls of the firetube assembly reduces the thermal efficiency of the steam producing device, and therefore increases operating costs, by reducing the heat transfer from the metal walls of the firetube assembly to the surrounding water. The walls of the firetube assembly are heated by hot gas flowing within the assembly. The reduction in heat transfer through the water results in longer cooking times, with regard to steam producing devices used in the cooking industry, which is not desirable. The thermal efficiency of electrically-heated units is reduced when scale accumulates on the electrical resistance heating rods which are disposed within the water contained within the outer housing of the steam producing device and are used to transfer heat to the water.

Another problem with scale build up of this type is that it may lead to distortion or failure of the firetube assembly, which is typically made of stainless steel. This may occur as follows. The scale may accumulate on the exterior surfaces of the firetube assembly unevenly, with the thickness of the scale varying from top to bottom of the firetube assembly. Typically, the scale thickness increases with the temperature of the surface. The walls of the firetube assembly are generally hotter near the bottom where the gas burners are typically located, and are cooler near the top since the "hot air" cools down, due to heat transfer, as it flows through the firetube assembly from bottom to top, typically through a tortuous flowpath. Locally thicker areas of scale build up create "hot spots" in the metal walls of the firetube assembly. As an example, an average local metal temperature may be about 300° F., with a gas flame temperature of about 1000° F. under normal circumstances. As a result of scale build up, less heat is transferred to the surrounding water, so that the local metal temperature rises significantly, such as to about 700° F. by way of example. This may cause the wall of the firetube assembly to distort locally. Also, as one skilled in the art may appreciate, the presence of multiple hot spots may cause the metal wall of the firetube assembly to move to the extent that various seam or spot welds are pulled apart causing expensive repair or replacement of the unit. For instance, the spot welds attaching various interior heat transfer baffles to the walls of the firetube assembly may fail, causing water leaks into the combustion chamber of the firetube assembly. Additionally, the welds which attach the firetube assembly to the outer housing of the steam producing device may fail, which may result in water leaking externally of the steam producing device.

Operational costs may also be increased due to scale buildup on the water level sensors. When this occurs to the extent that the sensors are "limed over", the sensors malfunction and are no longer able to detect the water level within the steam producing device. Typically, these sensors are part of a control circuit used to control water fill valves and the operation of the gas burners or electrical resistance heating elements within the steam producing device. Accordingly, when this occurs it may be necessary to shutdown and "de-lime" the device, which has been the industry standard for de-scaling water level sensors and attempting to de-scale the heat transfer surfaces within the steam producing device. A "de-liming" procedure is typically completed by pouring a chemical solution into the device, mixing it with water and running a cleaning cycle which adds to operating costs. The de-liming procedure may require the assistance of a service repairman or technician which further adds to operating costs.

Although de-liming procedures may be effective for cleaning the water level sensors and recovering thermal efficiency, by de-scaling various heat transfer surfaces such as the outer surfaces of the walls of a firetube assembly, other problems are created. During de-liming, pieces of scale, which may also be referred to as chips or chunks and vary in size and shape, are released and drop to the bottom of the steam producing device where they accumulate. Pieces of scale may also fall off during normal operation or during water filling and draining operations. When wet, these pieces tend to bond to one another forming a large mass of scale particles. When dry, the mass of scale particles is hard and brittle. Repeated de-liming procedures causes the accumulated mass of scale to grow in size which reduces the steam-generating capacity of the device due to reduced internal volume available for containing water. This also increases operating costs. Such an accumulation of scale may adversely affect water circulation within the steam producing device. As one skilled in the art may appreciate, when water boils, the water tends to rotate en masse, which mixes relatively hotter water with relatively cooler water within the steam producing device. However, the presence of significant scale build up within the unit may interrupt this natural convective flow of water, thereby reducing the efficiency of the unit.

Additionally, the buildup of scale in the bottom of the steam producing device may clog the drain system associated with the device. Steam producing devices such as a steam generator typically have a drain port extending through the housing of the device, which may be about two inches in diameter. However, a downstream drain valve, which is connected to the drain port by appropriate plumbing, may be much smaller, such as one-half inch diameter, due to cost considerations. Operators usually prefer remotely operated drain valves, such as electrically operated solenoid valves and, as known in the art, the price of these valves increases significantly with an increase in effective flow area. For instance, a nominal one-half inch solenoid valve may presently cost under one hundred dollars, whereas a nominal two inch solenoid valve may cost several hundred dollars. As may be appreciated, the presence of loose scale within the steam producing device may result in a relatively smaller flow area drain valve and associated plumbing becoming clogged before a relatively larger flow area drain port which may exist in the housing of the steam producing device. When the device drain is plugged, a potentially significant buildup of scale may result. This may lead to the various problems discussed previously.

Also, in extreme instances, the mass of accumulated scale may become so large that housing seam welds are broken or a "dry fire" may occur within the steam producing device causing the device to be replaced. The term "dry fire", as known in the art, refers to the condition when the gas burners or electrical resistance heating rods of the steam producing device are turned on when there is no water contained within the steam producing device, as a result of the volume available to contain water being substantially filled with the scale.

In view of the foregoing disadvantages associated with known steam producing devices, a need exists for a cost efficient way to de-scale steam producing devices, without the intervention of a service technician or repairman.

SUMMARY

In view of the foregoing needs, the present invention is directed to a pump and grinder assembly for use with a wide variety of steam producing devices, including, but not limited to steam generators and boilers used in the cooking industry, with the pump and grinder assembly being operatively effective for pumping water and loose scale contained within the water out of the steam producing device and grinding the scale into relatively smaller pieces which may be discharged out of the drain port of the pump and grinder assembly. The present invention is also directed to the associated methodology and, in one aspect, a combination of the pump and grinder assembly and a steam producing device. Use of the pump and grinder assembly of the present invention permits significantly reduced operating costs, relatively to those associated with known steam producing devices which are not used in combination with the pump and grinder assembly of the present invention, as well as decreased capital costs.

Operating costs are reduced as a result of use of the pump and grinder assembly of the present invention for a variety of reasons. In the first instance, thermal efficiency of the associated steam producing device is increased due to the periodic extraction of loose scale from within the housing of the steam producing device. Scale may be released during filling, draining or de-liming operations or during normal operation of the unit. The pump and grinder assembly includes a blade assembly which is in fluid flow communication with a water chamber defined by the housing of the steam producing device. Preferably, the blade assembly is rotated during each of the filling, draining and de-liming operations. This causes water, and any loose scale suspended within the water, to be pumped out of the housing of the steam producing device into a grinding chamber of the pump and grinder assembly, where the scale is ground into relatively smaller pieces by the blade assembly, and then discharged out of a drain port of the pump and grinder assembly. Accordingly, the scale does not accumulate within the housing of the steam producing device as described previously with regard to those devices which are not used in connection with the pump and grinder assembly of the present invention. Consequently, thermal efficiency is improved due to improved heat transfer to the water within the housing of the steam producing device, which results in lower cooking times and reduced costs to the operator. Also, the use of the pump and grinder assembly of the present invention results in several additional advantages to the operator of the associated steam producing device. For instance, since there is not a significant accumulation of scale within the housing of a steam producing device, the natural convective flow of water within the housing may occur when the water starts to boil, thereby mixing the relatively hotter and cooler water and improving the overall efficiency of the steam producing device which reduces operating costs. The absence of a significant accumulation or buildup of scale in the bottom of the housing of the steam producing device also permits the nominal steam capacity of the steam producing device to be substantially maintained, which also reduces operating costs. Further, since the loose scale is ground into relatively smaller pieces, use of the pump and grinder assembly of the present invention permits the use of relatively smaller and less expensive, remotely operated main valves, which reduces overall capital costs.

Use of the pump and grinder assembly significantly reduces the possibility of local hot spots and dry fires due to the periodic extraction of scale from within the housing of the steam producing device. Accordingly, use of the pump and grinder assembly of the present invention results in reduced chances of failure of the steam producing device and therefore a longer service life and reduced capital costs associated with the steam producing device.

According to a first aspect of the present invention, a pump and grinder assembly is provided for use with a steam producing device having a housing defining a water chamber and an aperture formed in the housing and communicating with the water chamber. The pump and grinder assembly of the present invention may be used with a wide variety of steam producing devices including steam generators, boilers, coffee makers and others. The pump and grinder assembly is operatively effective for pumping water and scale contained within the water out of the steam producing device and grinding the scale into relatively smaller pieces with may be discharged out of a drain port of the pump and grinder assembly. The scale may comprise calcium carbonate, also known as lime, or other mineral-based compounds. According to one preferred embodiment, the pump and grinder assembly includes a motor having a rotatable output shaft and a pump and grinder shaft coupled to the output shaft of the motor for rotation therewith. The pump and grinder assembly also includes a blade assembly having a plurality of blades, with the blade assembly being secured to the pump and grinder shaft for rotation therewith. A housing is interconnected to a stationary portion of the motor, with the housing defining a grinding chamber. The plurality of blades is disposed within the grinding chamber. The drain port is formed in the housing and communicates with the grinding chamber. Additionally, the drain port is disposed downstream of the blades. The pump and grinder assembly is mountable on the steam producing device so that the grinding chamber communicates with the water chamber of the steam producing device, permitting water and scale contained within the water to be pumped out of the steam producing device into the grinding chamber and then subsequently discharged through the drain port.

The pump and grinder assembly may further include a motor mount bracket having a first end portion attached to the motor, and a second opposite end portion. The assembly may also include a seal disposed between, and in sealing engagement with, the second end portion of the motor mount bracket and the housing. The seal, motor mount bracket and housing are secured to one another and, preferably, are fastened to one another.

The pump and grinder assembly may also include a hollow connecting member which may be used to mount the pump and grinder assembly on the steam producing device. Accordingly, the hollow connecting member may have various configurations, depending upon the particular steam producing device on which the pump and grinder assembly is mounted. The hollow connecting member has a downstream, proximal end secured to the housing of the pump and grinder assembly and an upstream, distal end terminating in a mount flange. The mount flange has a plurality of mount holes formed therein, with the mount holes being effective for receiving fasteners to attach the pump and grinder assembly to the steam producing device. The mount flange also has a generally centrally disposed aperture formed therein, with the aperture of the mount flange being substantially aligned with the aperture or drain port formed in the housing of the steam producing device when the pump and grinder assembly is attached to the steam producing device. Accordingly, an interior portion of the hollow connecting member and the grinding chamber are in communication with the water chamber of the steam producing device. The motor preferably comprises an electric motor and even more preferably comprises an alternating current electric motor. However, the motor may also comprise a direct current electric motor.

In one embodiment, the blade assembly further includes a first blade-supporting portion and a second blade-supporting portion, with the first and second blade-supporting portions being secured to the pump and grinder shaft for rotation therewith. In this embodiment, the plurality of blades includes first and second pluralities of blades, with the first plurality of blades being integral with the first blade supporting-portion and the second plurality of blades being integral with the second blade-supporting portion. Preferably, the blades are made as a one piece construction with the corresponding blade-supporting portion.

The first blade-supporting portion is disposed forward, or upstream of the second blade-supporting portion. In one embodiment the first plurality of blades extend radially outwardly and forwardly or upstream from the first blade-supporting portion and the second plurality of blades extend radially outwardly and rearwardly, or downstream, from the second blade-supporting portion. However, it should be understood that a wide variety of blades are suitable for use in the pump and grinder assembly of the present invention, provided that they are effective for pumping water and loose scale contained in the water out of the steam producing device and then grinding the loose scale contained within the water into relatively smaller pieces. In this embodiment, the first plurality of blades comprises a pair of blades, each having a blade tip, with the blade tips being separated by a first distance. A lateral or transverse internal dimension of the downstream, proximal end of the hollow connecting member is preferably less than or equal to this first distance separating the pair of blade tips so that the scale does not bypass the blades as water and the included scale is pumped through the blade assembly. The downstream, proximal end of the hollow connecting member has a circular cross-section in one embodiment, with the lateral or transverse internal dimension of this portion of the hollow connecting member being an internal diameter.

The pump and grinder assembly may further include a gasket which is disposed between the mount flange of the connecting member and the steam producing device when the pump and grinder assembly is mounted to the steam producing device. The gasket has a plurality of mount holes equal in number to, and alignable with, the mount holes formed in the mount flange of the connecting member. The gasket also has a generally centrally disposed aperture which is substantially equal in size to the generally centrally disposed aperture formed in the mount flange of the connecting member.

In one preferred embodiment, the pump and grinder shaft includes a first substantially cylindrical portion having a first outside diameter, and a second substantially cylindrical portion having a second outside diameter. The first and second substantially cylindrical portions are integral with one another, with the second outside diameter being less than the first outside diameter. The blade assembly is secured to the first substantially cylindrical portion of the pump and grinder shaft at an end opposite the second, reduced diameter substantially cylindrical portion of the shaft. In this embodiment, the pump and grinder shaft further includes a threaded portion, having external threads, which is integral with the second substantially cylindrical portion at an end opposite the first, relatively larger diameter substantially cylindrical portion of the shaft. In this embodiment, the assembly further includes a hollow coupling having a first end portion with internal threads which are engaged with the threaded portion of the pump and grinder shaft. Additionally, a set screw is provided, which protrudes through a hole in the wall of the hollow coupling and engages the rotatable output shaft of the motor, whereby the hollow coupling and set screw combine to rotatably couple the pump and grinder shaft to the rotatable output shaft of the motor. In other embodiments, the rotatable output shaft of the motor may be threadedly engaged with the coupling, with the pump and grinder shaft being secured to the coupling via the set screw. Also, it is noted that a flexible coupling may be used within the scope of the present invention. As known in the art, a flexible coupling refers to a coupling which may be used to accommodate some misalignment between shafts being coupled, in this case the rotatable output shaft of the motor and the pump and grinder shaft.

In a preferred embodiment, a bearing is provided having a flange portion and a substantially cylindrical portion integral with the flange portion. The substantially cylindrical portion extends longitudinally through the second end portion of the motor mount bracket which is disposed away from the motor, and the flange portion of the bearing is disposed in contacting engagement with a first surface of this portion of the motor mount bracket, which faces away from the motor. An annular, elastomeric seal is disposed longitudinally between the first, relatively larger, substantially cylindrical portion of the pump and grinder shaft and the flange portion of the bearing. This seal is disposed in surrounding relationship with the second, relatively smaller, substantially cylindrical portion of the pump and grinder shaft. A combination of this seal and the gasket which is disposed in sealing engagement with the bearing and hollow coupling substantially prevent water from entering the chamber defined by the motor mount bracket.

According to a second aspect of the present invention, an assembly is provided which includes a steam producing device and a pump and grinder assembly mounted on the steam producing device. The pump and grinder assembly may include the various features of the previously discussed embodiments of the present invention. The steam producing device includes a housing defining a water chamber and a fill port formed in the housing and communicating with the water chamber such that the fill port is effective for receiving water therethrough. The steam producing device further includes a drain port formed in the housing and communicating with the water chamber, and a heating device disposed at least partially within the water chamber. The heating device is effective for transferring heat to the water contained within the water chamber during operation of the heating device. In one embodiment, the heating device includes one or more electrical resistance heating rods. In other embodiments, the steam producing device may be gas-fired, with the heating device including a gas manifold, gas burners and an associated firetube assembly disposed within the housing of the steam producing device. In this case, air is heated by the gas burners, with the air then flowing through the firetube assembly which results in heat being transferred through the metal walls of the firetube assembly to the water contained within the housing between an interior surface of the housing and the firetube assembly.

The pump and grinder assembly is operatively effective for pumping water and scale, which is loose and disposed or contained within the water, out of the housing of the steam producing device and grinding the scale into relatively smaller pieces. This scale is typically lying on a bottom of the housing of the steam producing device. Preferably, the fill port and a drain port of the steam producing device are longitudinally spaced apart. This relative positioning of the fill port and drain port assists in moving water and the included scale toward the pump and grinder assembly during periods when the blade assembly is rotated within the grinding chamber.

According to a third aspect of the present invention, a method is provided for extracting loose scale contained in water from within a water chamber of a steam producing device and processing the scale for draining. According to one preferred embodiment, the method comprises the steps of: pumping at least a portion of the water and the scale contained therein out of the water chamber of the steam producing device; and grinding at least some of the scale into relatively smaller pieces.

The method according to the present invention may further include the step of mounting a pump and grinder assembly to a housing of the steam producing device, with the housing defining the water chamber of the steam producing device, and the pump and grinder assembly including a grinding chamber and a plurality of rotatable blades disposed within the grinding chamber. The method may also include the step of providing communication between the water chamber of the steam producing device and the grinding chamber of the pump and grinder assembly. This permits water and loose scale contained within the water to be pumped from the water chamber to the grinding chamber. Additionally, at least one of the step of pumping and the step of grinding may include the step of rotating the plurality of rotatable blades disposed within the grinding chamber.

BRIEF DESCRIPTION OF THE DRAWINGS

These and other features, aspects and advantages of the present invention will become better understood with regard to the following description, appended claims and accompanying drawings wherein:

DETAILED DESCRIPTION

Figure 1:
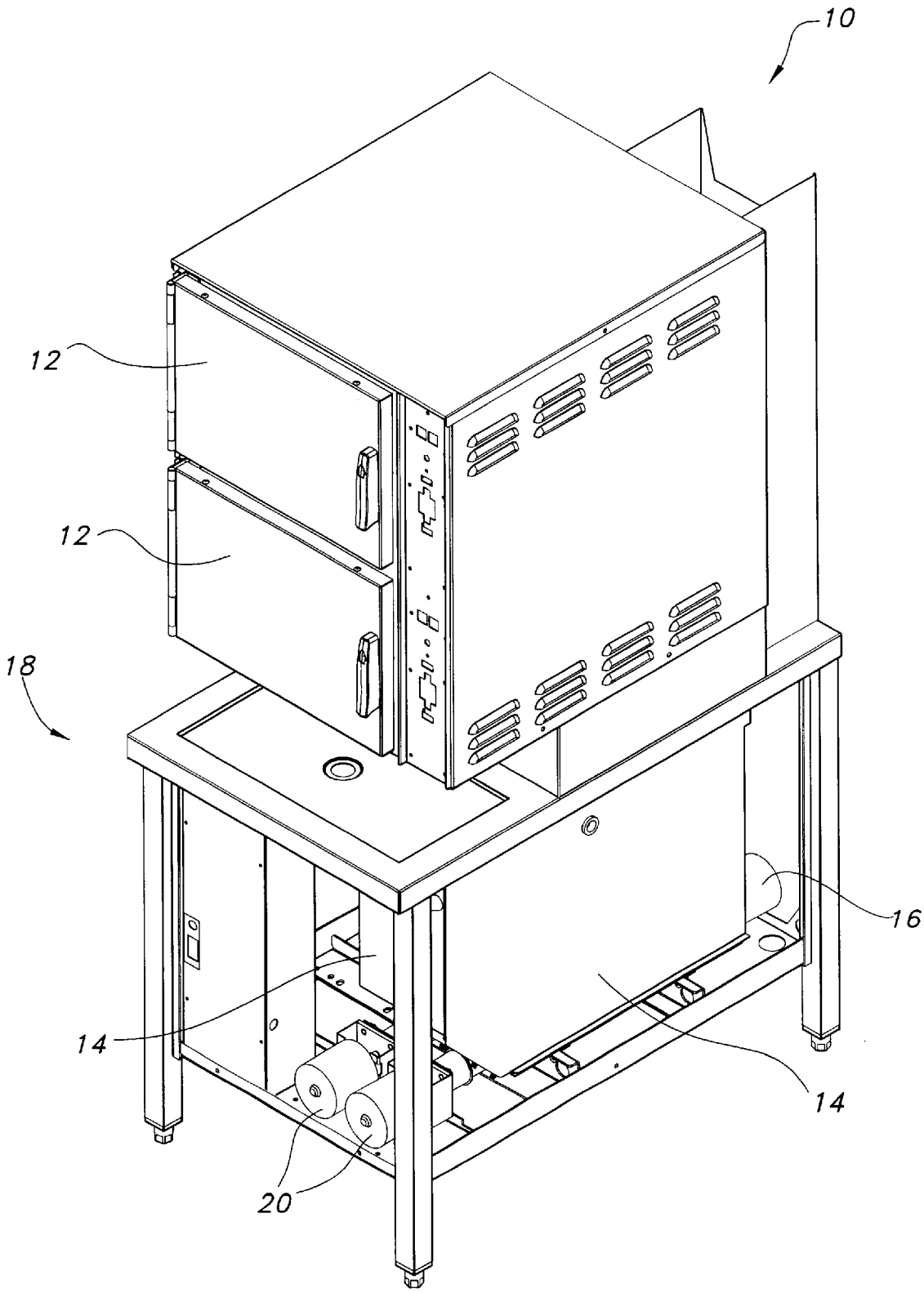
FIG. 1 is an isometric view of a double-oven type steamer apparatus which includes two steam producing devices and associated pump and grinder assemblies, according to the present invention.

Referring now to the drawings, FIG. 1 is an isometric view illustrating a double-oven steamer apparatus 10 which includes a pair of convection-type steamer ovens 12 and a corresponding pair of steam producing devices 14. Each of the steam producing steam devices 14 of apparatus 10 is an atmospheric steam generator and, as subsequently discussed, the water within each of the steam producing devices 14 is heated to a boiling temperature by a heating device 16, best seen in FIG. 2. The heating device 16 included in apparatus 10 is an electrical heating device. As shown in FIG. 1, the ovens 12 and steam generators 14 are supported by a structure indicated generally at 18. Each of the steam generators 14 is used in conjunction with a pump and grinder assembly 20, according to the present invention.

The pump and grinder assemblies 20 illustrated in FIG. 1 are used in conjunction with electrically heated steam generators 14. However, it should be understood that this application of the pump and grinder assembly 20 is shown by way of illustration, and not of limitation. For instance, the pump and grinder assemblies 20 may be used in conjunction with a pair of gas-fired steam generators, otherwise similar to steam generators 14. Additionally, the pump and grinder assemblies 20 may be used in combination with a pair of steam boilers, either electrically heated or gas fired, in lieu of the atmospheric steam generators 14. Furthermore, a single pump and grinder assembly may be used with a single steam generator or boiler, either electrically heated or gas-fired which is used in conjunction with a single convection-type steamer oven.

Water is supplied to each of the steam producing devices 14 in a conventional manner. The heating device 16, is an electrical resistance heating device in the illustrative embodiment and is used during cooking cycles to heat the water contained within the steam producing devices 14 to a boiling temperature such that steam is produced. Steam is discharged out of each of the steam producing devices 14 by a steam discharge port 22 and a steam discharge conduit (not shown) which communicates with a steam inlet housing (not shown) of the corresponding oven 12, in a manner well known in the art. The steam then passes through the steam inlet housing into the cooking chamber (not shown) of the oven 12. The manner in which steam is conveyed from steam producing devices 14 to ovens 12, as well as the various features of the ovens 12, do not comprise a part of the present invention.

Figure 2:
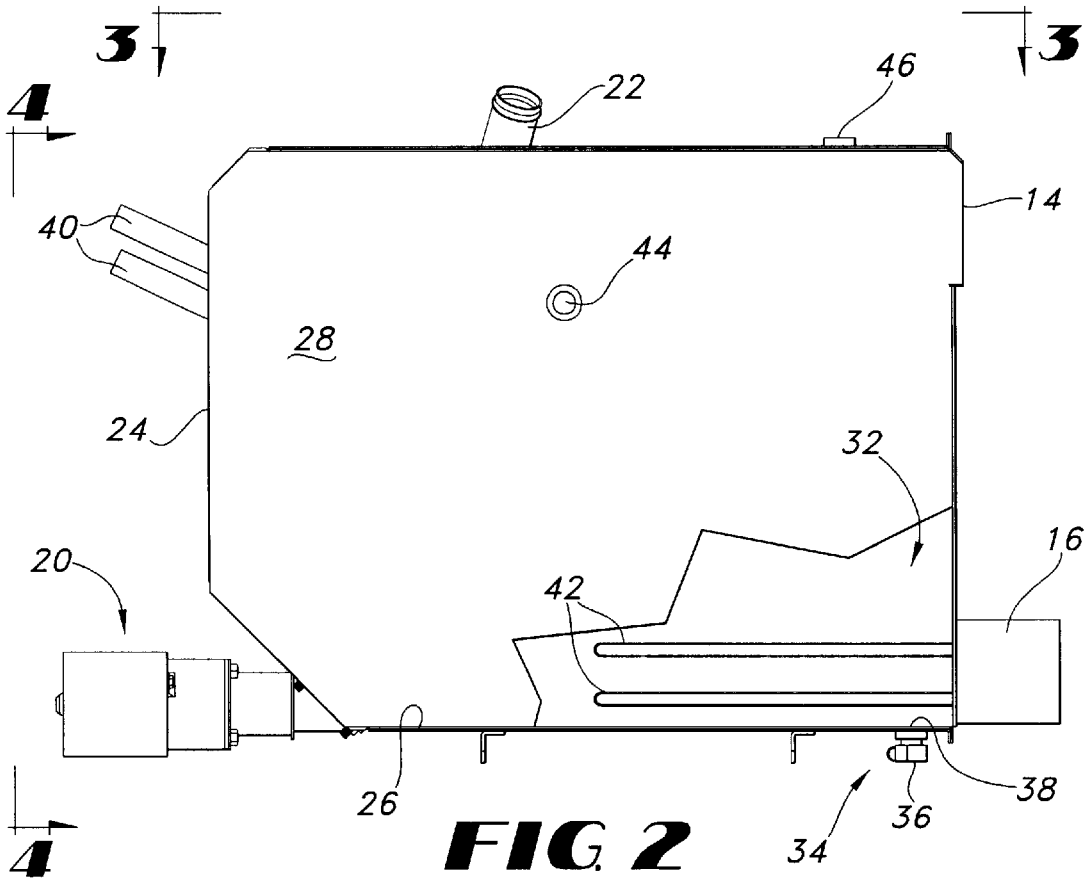
FIG. 2 is a side elevation view of one of the steam producing devices and associated pump and grinder assemblies shown in FIG. 1.
Figure 3:
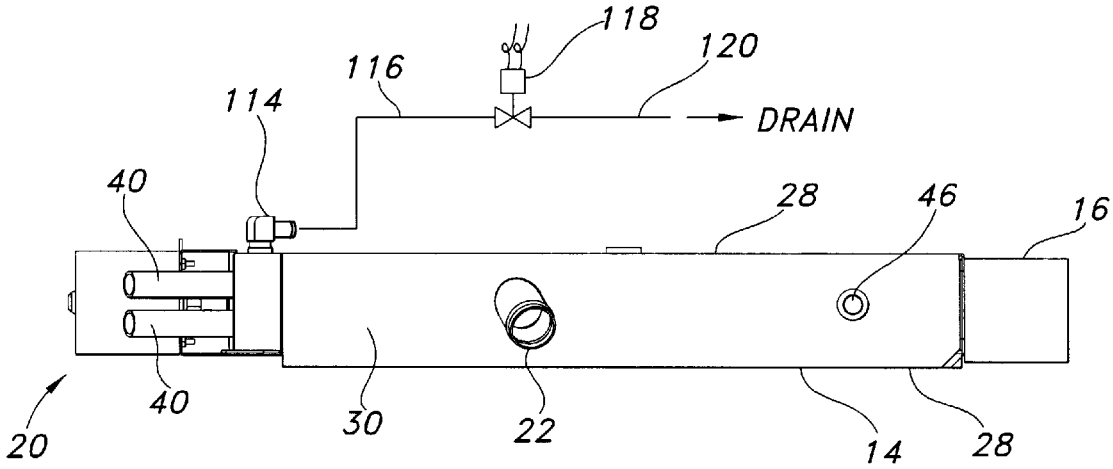
FIG. 3 is a top plan view taken along line 3—3 in FIG. 2.
Figure 4:
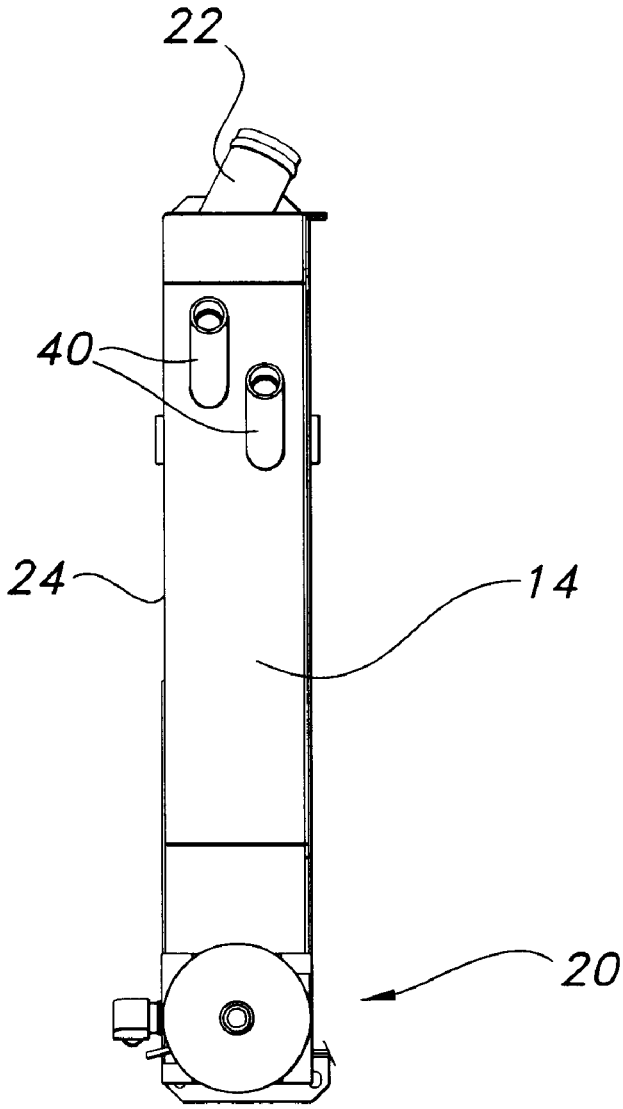
FIG. 4 is a front elevation view taken along line 4—4 in FIG. 2.

Various included features of each of the steam generators 14 are illustrated with regard to one of the steam generators 14, in FIGS. 2–4. Steam generator 14 includes a housing 24 which has a bottom 26, a pair of sidewalls 28 supported by the bottom 26 and extending upwardly therefrom, and a top 30 secured to each of the sidewalls 28.

Housing 24 is hollow and defines a water chamber 32, which is suitable for containing water within housing 24. The steam generator 14 further includes a fill device indicated generally at 34 which includes a connector 36, suitable for attachment to a water fill hose (not shown) and a fill port indicated generally at 38 and formed in the bottom 26 of housing 24 which communicates with the water chamber 32. Accordingly, the fill device 34 is effective for supplying water from a source of water to the water chamber 32. The water level within the water chamber 32 is sensed by a pair of water level sensors 40, of conventional construction. As known in the art, the water level sensors 40 are mounted on housing 24 and extend therethrough, with a tip (not shown) of each sensor 40 used to sense the presence of water within chamber 32.

The electrical heating device 16 of steam generator 14 includes one or more electrical resistance heating elements 42. In the illustrative embodiment, the heating device 16 includes a pair of the elements 42, as shown in the partial cutaway view of FIG. 2, which extend into the water chamber 32. At appropriate times during the operation of the apparatus 10, electrical power may be supplied to the heating device 16, which may be controlled by the water level sensors 40 as known in the art, so that heat is transferred from the elements 42 to water (not shown) contained within the water chamber 32. This causes the water to be heated to a boiling temperature, which produces steam. The steam is discharged through discharge port 22, flowing to the corresponding oven 12 as discussed previously.

Steam generator 14 further includes a high limit sensor 44, shown in FIG. 2, which senses metal temperature and is used to detect conditions indicating a possible future dry fire, in the absence of maintenance activities to eliminate the condition. It is further noted that dry fires are very rare within the industry. The steam generator 14 further includes a pressure relief port 46 shown in FIG. 3 which may used in conjunction with a pressure relief valve (not shown).

Referring now to FIGS. 5–8, the various features of one of the pump and grinder assemblies 20 is further illustrated, according to one embodiment of the present invention. The pump and grinder assembly 20 includes a motor, indicated generally at 50, having a housing 52 and a rotatable output shaft 54. Motor 50 further includes a shaft seal 56 disposed in surrounding relationship with shaft 54 at the interface with housing 52.

Figure 5:
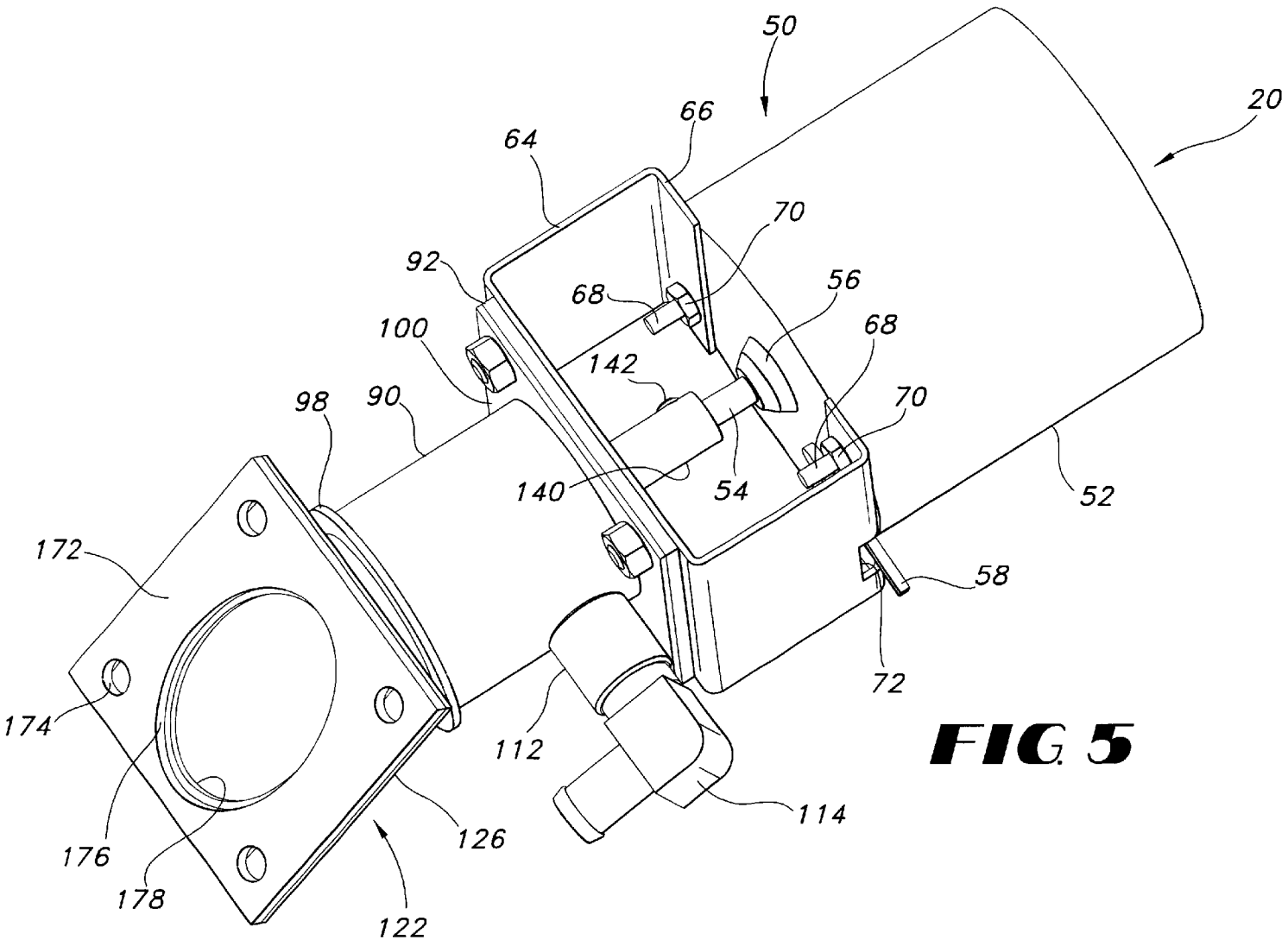
FIG. 5 is an enlarged isometric view of a pump and grinder assembly according to the present invention.

In the illustrative embodiment, the motor 50 is an alternating current electric motor, with electric power being provided to motor 50 from a source of electric power (not shown) via an electrical connector (not shown), such as a plug adaptable for engaging a wall outlet for instance, and wires 58 shown in FIG. 5. In the illustrative embodiment, the electrical power provided to motor 50 may be 110 VAC or alternatively 24 VAC. In one embodiment, the inventor has determined that a single speed motor, having a rated speed of about 1200 rpm and one-third horse power, is sufficient for use since this motor has sufficient torque to grind scale with the subsequently described blade assembly included in the pump and grinder assembly 20.

The pump and grinder assembly 20 further includes a pump and grinder shaft 60 coupled to the rotatable output shaft 54 of the motor 50, for rotation therewith. A blade assembly, indicated generally at 62, is secured to the pump and grinder shaft 60, for rotation therewith as subsequently discussed in greater detail.

The pump and grinder assembly 20 also includes a motor mount bracket 64 having a first end portion 66 which is secured to the stationary housing 52 of motor 50 via a plurality of fasteners, such as bolts or screws 68 and nuts 70. The motor mount bracket 64 further includes a notch 72 formed therein which is effective for receiving the electrical wires 58 therethrough, as shown in FIG. 5.

Figure 6:
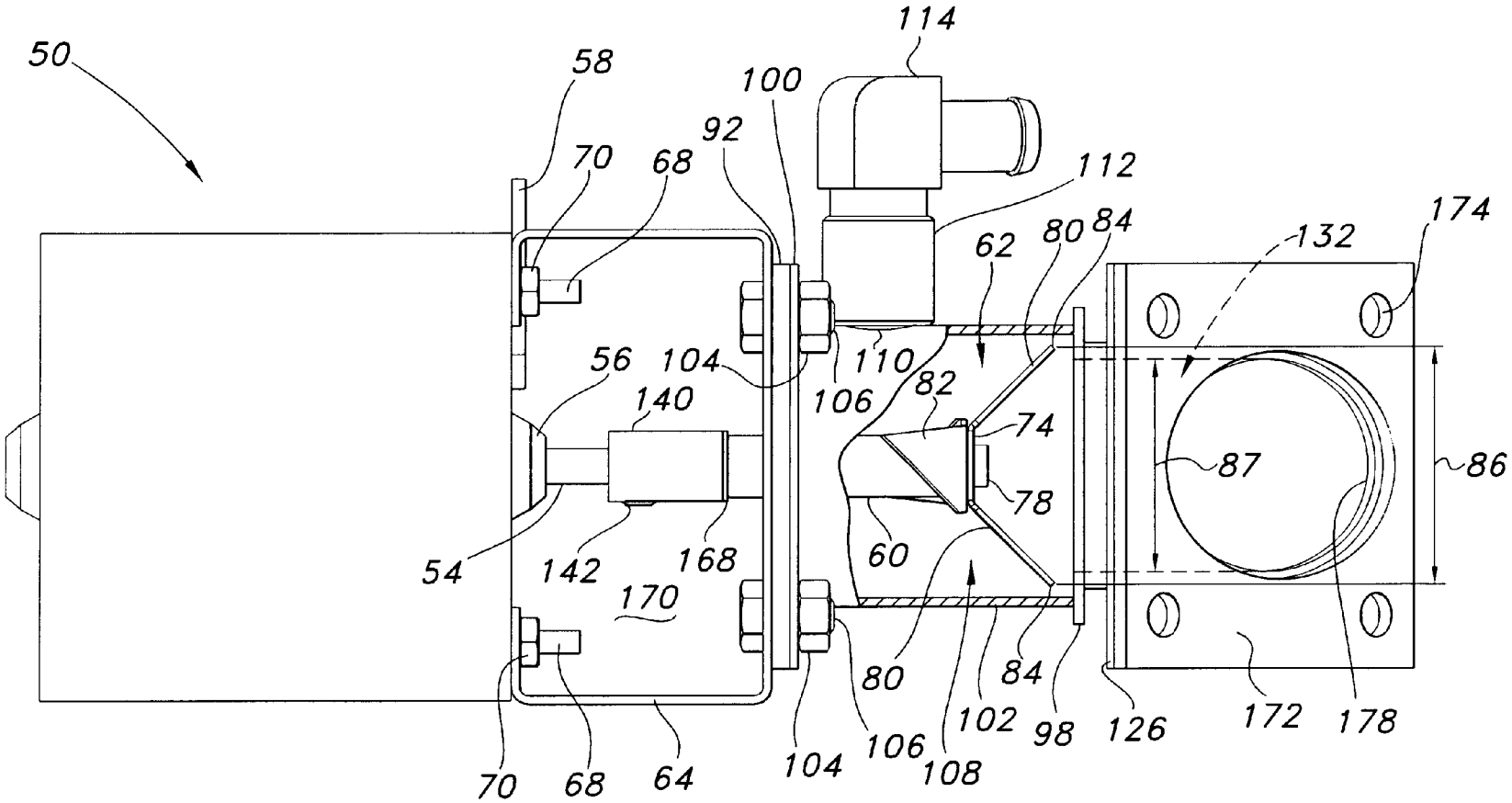
FIG. 6 is a longitudinal view, partially in cut-away view and partially in cross-section, of the pump and grinder assembly shown in FIG. 6.
Figure 7:
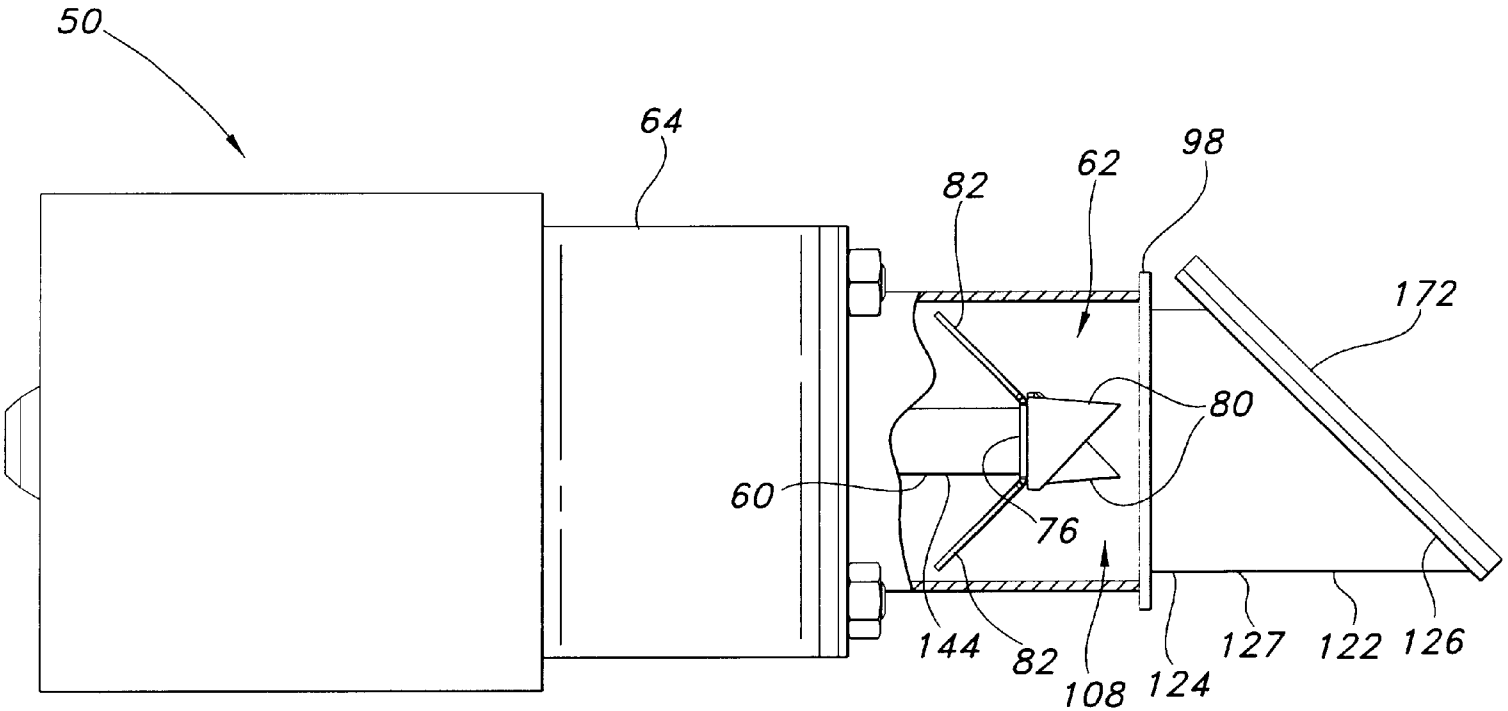
FIG. 7 is another longitudinal view, partially in cut-away view and partially in cross-section, rotated relative to FIG. 6, further illustrating the pump and grinder assembly shown in FIGS. 5 and 6.
Figure 8:
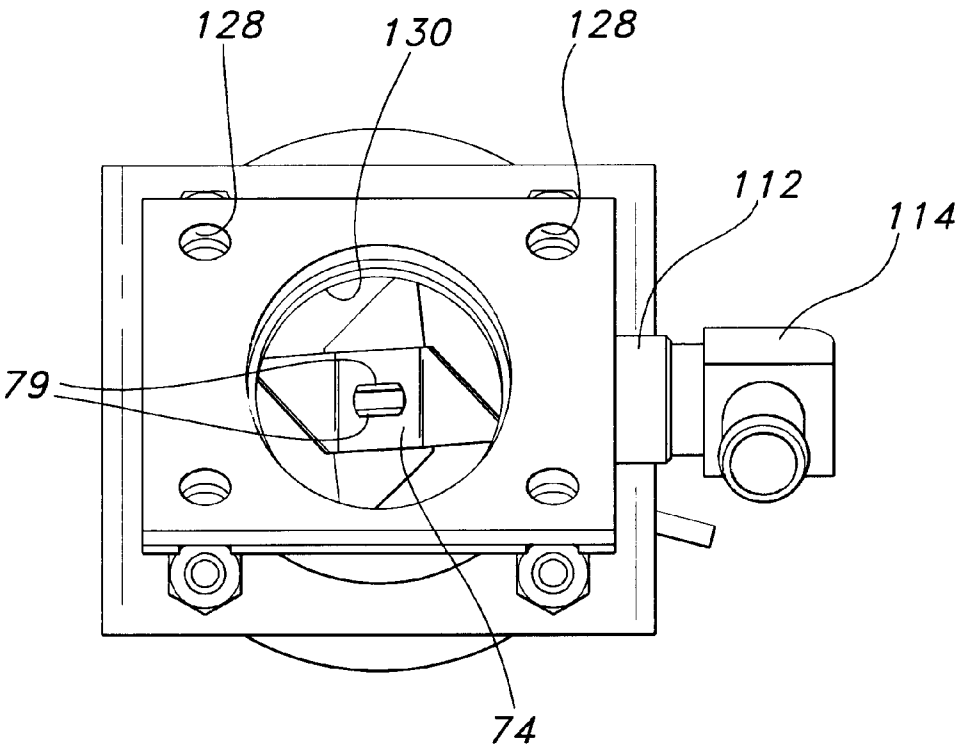
FIG. 8 is an end view of the pump and grinder assembly shown in FIGS. 5–7.
Figure 9:
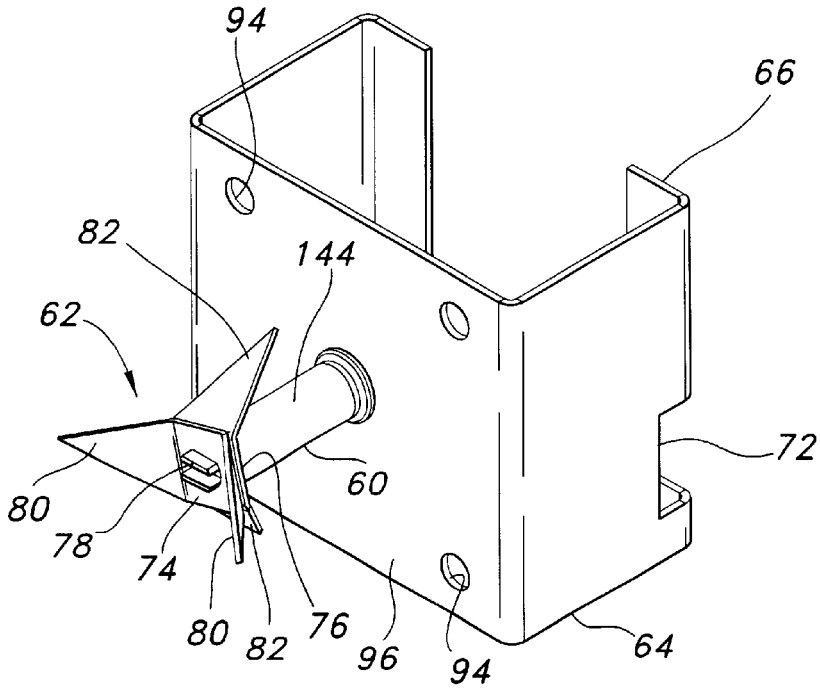
FIG. 9 is an isometric view of a sub-assembly of the pump and grinder assembly shown in FIGS. 5–8, further illustrating a portion of the pump and grinder assembly.
Figure 10:
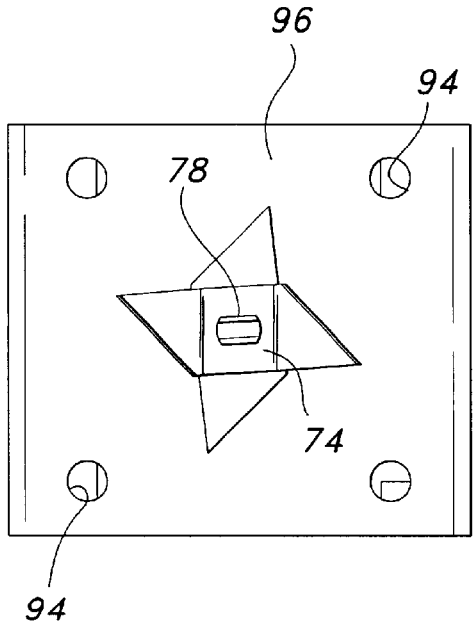
FIG. 10 is an end view of the sub-assembly shown in FIG. 9.
Figure 11:
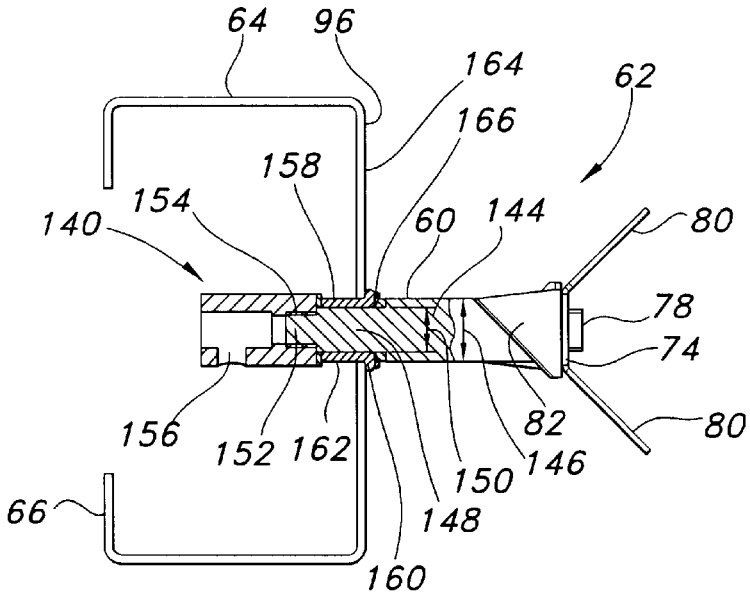
FIG. 11 is a top view, partially in cross-section, of the sub-assembly shown in FIGS. 9 and 10.
Figure 12:
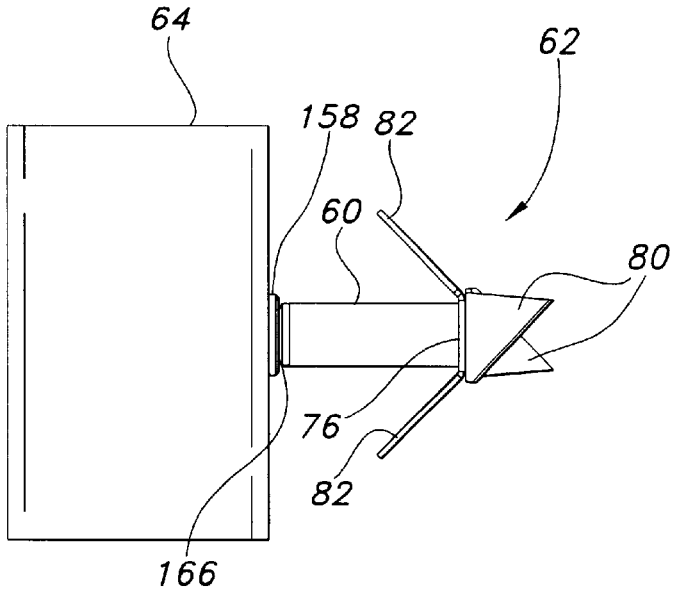
FIG. 12 is a side view of the sub-assembly shown in FIGS. 9–11.

The blade assembly 62 includes a first blade-supporting portion 74 (shown in FIGS. 6 and 8–11) and a second blade-supporting portion 76 best seen in FIGS. 7, 9 and 12 which are secured to the pump and grinder shaft 60, for rotation therewith, via a retainer 78 which is integral with the pump and grinder shaft 60. In the illustrative embodiment, pump and grinder shaft 60 and retainer 78 are made as a one piece construction. As best seen in FIGS. 8–10, the retainer 78 includes a pair of spaced apart tabs 79 which extend through apertures formed in the blade-supporting portions 74 and 76. These tabs 79 may be spread apart somewhat after insertion through the blade-supporting portions 74 and 76, so as to secure the blade assembly 62 to the pump and grinder shaft 60, for rotation therewith.

The blade assembly 62 also includes a first plurality of blades 80 which are integral with the first blade-supporting portion 74, and a second plurality of blades 82 which are integral with the second blade-supporting portion 76. Preferably, blades 80 are formed as a one piece construction with blade-supporting 74 and similarly blades 82 are preferably formed as a one piece construction with blade-supporting portion 76. In the illustrative embodiment, blade assembly 62 includes two of the blades 80 and two of the blades 82. It should be understood that blade assembly 62 may include additional blades 80 and 82, and further that various other configurations of blades, with regard to size, shape and number of blades, may be used in lieu of blades 80 and 82 provided that the alternative configurations are substantially rotatably balanced and are effective for pumping water and loose scale disposed within the water out of the steam producing device 14 and grinding the scale into relatively smaller pieces as subsequently discussed in greater detail with regard to blades 80 and 82. The blades 80 extend radially outwardly and forwardly, or upstream, from the first blade-supporting portion 74 and the blades 82 extend radially outwardly and rearwardly, or downstream, from the second blade-supporting portion 76.

The pump and grinder assembly 20 further includes a housing 90 which is interconnected to the stationary housing 52 of motor 50. The assembly further includes a gasket 92 having a plurality of holes (not shown) formed therein, which are equal in number and substantially equal in size and spacing to a plurality of holes 94 formed in a second end portion 96 of the motor mount bracket 64. The housing 90 includes a first, upstream flange 98, a second, downstream flange 100 and an intermediate portion 102 extending between and secured to the flanges 98 and 100. In a preferred embodiment, the intermediate portion 102 is made of metal tubing. The flange 100 of housing 90 includes a plurality holes (not shown) formed therein having a pattern which substantially matches the hole pattern in gasket 92 and the pattern of holes 94 formed in the second end portion 96 of motor mount bracket 64. The gasket 92 and the flange 100 of housing 90 are secured to the second end portion 96 of motor mount bracket 64 via a plurality of fasteners such as bolts 104 and nuts 106.

The housing 90 defines a grinding chamber 108, with the pump and grinder shaft 60 extending into the grinding chamber 108. Blade assembly 62 is disposed within chamber 108 for rotation therein. The pump and grinder assembly 20 further includes a drain port 110 formed in the housing 90 and communicating with the grinding chamber 108. A connecting member 112, which is a pipe coupling in the illustrative embodiment, is secured to the housing 90. Preferably, the coupling 112 is welded to housing 90. An elbow 114 is threadedly secured to coupling 112. When assembly 20 is mounted on the steam producing device 14, the elbow 114 may be connected to a drain conduit 116 as shown schematically in FIG. 3. Conduit 116 is secured to a remotely-operated electrical solenoid drain valve 118. Another conduit 120 is plumbed or connected to a discharge port of the solenoid valve 118 and is connected to a drain of the facility utilizing apparatus 10. Solenoid valve 118 and conduits 116 and 120 are not a part of the pump and grinder assembly 20.

The pump and grinder assembly 20 further includes a hollow connecting member 122 having a downstream, proximal end portion 124 secured to the housing 90 of the pump and grinder assembly 20. In one embodiment, the proximal end portion 124 is welded to the flange 98 of the housing 90. The connecting member 122 further includes an upstream, distal end terminating in a mount flange 126 having a plurality of mount holes 128 formed therein, with the mount holes 128 being effective for receiving fasteners (not shown) to attach the pump and grinder assembly 20 to the steam producing device 14. The mount flange 126 further includes a generally centrally disposed aperture 130 which is substantially aligned with a drain port (not shown) extending through the housing 24 of the steam producing device 14 when the pump and grinder assembly 20 is attached to the steam producing device 14. Accordingly, an interior portion 132 of the hollow connecting member 122 and the grinding chamber 108 are in communication with the water chamber 32 of the steam producing device 14. Each of the blades 82 includes a blade tip 84, with the tips 84 being separated by distance 86. In the illustrative embodiment, the proximal end portion 124 of the connecting member 122 has a lateral or transverse internal dimension 87 which, in the illustrative embodiment, is an internal diameter. The diameter 87 is preferably less than or equal to the distance 86 separating the blade tips 84 of blades 80, so that the water and scale contained within the water may not bypass blades 80 as the water and scale flow through the blade assembly 62.

The pump and grinder assembly further includes a coupling 140 and a set screw 142 which are effective for coupling the rotatable output shaft 54 motor 50 with the pump and grinder shaft 60. The pump and grinder shaft 60 includes a first substantially cylindrical portion 144 having a first outside diameter 146 and a second substantially cylindrical portion 148 having a second outside diameter 150. The first 144 and second 148 substantially cylindrical portions of the pump and grinder shaft 60 are integral with one another and, preferably, the first diameter 146 is larger than the second diameter 150. Shaft 60 further includes a threaded portion 152, having external threads which is integral with the second substantially cylindrical portion 148. The hollow coupling 140 has a first end portion 154 with internal threads which are threadedly engaged with the external threads of the threaded portion 152 of shaft 60. Further, in the illustrative embodiment, the set screw 142 protrudes through a hole 156 formed in a wall of the hollow coupling 140 and engages the rotatable output shaft 54 of motor 50. Accordingly, the hollow coupling 140 and the set screw 142 combine to rotatably couple the pump and grinder shaft 60 to the rotatable output shaft 54 of motor 50. It should be understood, that, in other embodiments, the coupling 140 may be threadedly engaged with a threaded end of the output shaft 54 of motor 50, with the set screw 142 passing through a hole such as 156 in the wall of coupling 140 so as to engage the pump and grinder shaft 60.

The pump and grinder assembly 20 further includes a bearing 158 having a flange portion 160 and a substantially cylindrical portion 162 integral with the flange portion 160. The substantially cylindrical portion 162 extends longitudinally through the second, opposite end portion 96 of the motor mount bracket 64. The flange portion 160 is disposed in contacting engagement with a surface 164 of the portion 96 of motor mount bracket 64. The surface 164 faces away from the motor 50. The pump and grinder shaft 60 extends longitudinally through the bearing 158 and is rotatable within, and relative to, the bearing 158.

An annular, elastomeric seal 166 is disposed longitudinally between the first substantially cylindrical portion 144 of the pump and grinder shaft 60 and the flange portion 160 of bearing 158. In the illustrative embodiment, the seal 166 has a generally V-shaped cross section, but other configurations of seals may be used. The seal 166 is disposed in surrounding relationship with the second, substantially cylindrical portion 148 of shaft 60. As shown in FIG. 6, a gasket 168 is disposed in sealing engagement with the bearing 158 and the hollow coupling 140. The seal 166 and gasket 168 combine to substantially prevent water from entering the interior space 170 defined by mount brackets 64 and motor 50.

A gasket 172, best seen in FIG. 5, is disposed between the flange portion 126 of the connecting member 122 and the steam producing device 14 when the pump and grinder assembly 20 is mounted on the steam producing device 14. Gasket 172 has a plurality of mount holes 174 which are in equal in number to, and alignable with, the mating mount holes formed in the mount flange 126 of the connecting member 122. Gasket 172 further includes a generally centrally disposed aperture 176 which is substantially equal in size to an aperture 178 formed in flange in 126 of connecting member 122.

According to another aspect of the present invention, the invention is directed to a combination of the pump and grinder assembly 20 and the steam producing device 14. The steam producing device 14 includes a drain port which passes through the housing 24 of device 14, at the location where the pump and grinder assembly 20 is mounted on housing 24. As may be appreciated from FIG. 2, this drain port and the fill port 38 are spaced longitudinally apart from one another, which facilitates directing water and scale toward the pump and grinder assembly 20 during the portion of the filling operation when the rotatable blade assembly 62 is activated, or is rotating, as subsequently discussed in greater detail.

According to another aspect of the present invention, the present invention is directed to a method for extracting loose scale contained in the water within the water chamber 32 of the steam producing device 14 and processing the scale for draining. The method of the present invention includes the steps of: pumping at least a portion of the water and the scale contained therein out of the water chamber 32 of the steam producing device 14; and grinding at least some of the scale contained in the water into relatively smaller pieces. The method may further include the steps of mounting the pump and grinder assembly 20 to the housing 24 of the steam producing device 14 and providing communication between the water chamber 32 of the steam producing device 14 and the grinding chamber 108 of the pump and grinder assembly 20 so that water and at least some of the scale contained therein may flow between the water chamber 32 and the grinding chamber 108. At least one of the steps of pumping and grinding includes the step of rotating the blades 80 and 82 of the blade assembly 62 within the grinding chamber 108.

Preferably, the blade assembly 62 of the pump and grinder assembly 20 is activated, or turned on, so that the blade assembly 62 is rotated for at least a portion of the time when the steam producing device 14 is being filled with water, water is being drained from the steam producing device 14 and when the steam producing device 14 is being de-limed by introducing a de-liming solution into the steam producing device 14. When the blade assembly 62 is rotated, the pumping action of blades 80 and 82 cause water and at least a portion of the scale contained within the water to be pumped out of the water chamber 32 through the drain port of the steam producing device 14, through the interior portion 132 of the connecting member 122, and into the grinding chamber 108. The configuration of the blades 80 and 82 are such that the scale contained with the water pumped into grinding chamber 108 is ground into relatively smaller pieces. Additionally, blades 80 act as a centrifuge, which forces the pieces of scale radially outwardly where they pass through the annular space between the tips 84 of blades 80 and the inner surface of the wall of housing 90. The scale then flows downstream within housing 90 and out through the drain port 110 formed in housing 90. From there, the scale flows through coupling 112, and elbow 114 to the drain conduit 116. The scale then passes through solenoid valve 118, and drain conduit 120 as it flows toward the drain of the facility in which the apparatus 10 is contained.

Use of the pump and grinder assembly of the present invention results in significant advantages to the operator of the associated steam producing device such as the steam producing devices 14 included in the double-oven steamer apparatus 10. These advantages will be discussed in conjunction with the pump and grinder assembly 20, according to one embodiment of the present invention, and steam producing device 14. However, it should be understood that these advantages also apply to other embodiments of the pump and grinder assembly of the present invention, and when the pump and grinder assembly of the present invention is used with other steam producing devices.

Operating costs are reduced as a result of the use of the pump and grinder assembly 20 of the present invention for a variety of reasons. In the first instance, thermal efficiency of the associated steam producing device 14 is increased due to the periodic extraction of loose scale from within the housing 24 of the steam producing device 14. Preferably, the blade assembly 62 is rotated during each of the filling, draining and de-liming operations since scale may be released during each of these operations. This causes water, and at least a portion of the loose scale contained within the water, to be pumped out of the housing of the steam producing device into the grinding chamber 108 of the pump and grinder assembly 20, where the scale is ground into relatively smaller pieces by the blade assembly, and then discharged out of the drain port 110 of the pump and grinder assembly 20. Accordingly, the scale does not buildup within the housing 24 of the steam producing device 14 as described previously with regard to those steam producing devices which are not used in connection with the pump and grinder assembly 20 of the present invention. Consequently, thermal efficiency is improved due to improved heat transfer to the water within the housing 24 of the steam producing device 14, which results in lower cooking times and reduced costs to the operator.

Also, the use of the pump and grinder assembly 20 of the present invention results in several additional advantages to the operator of the associated steam producing device. For instance, since there is not a significant accumulation of scale within the housing 24 of the steam producing device 14, the natural convective flow of water within the housing may occur when the water starts to boil, thereby mixing the relatively hotter and cooler water and improving the overall efficiency of the steam producing device 14 which reduces operating costs. The absence of a significant buildup of scale from the bottom of the housing 24 of steam producing device 14 also permits the nominal steam capacity of the steam producing device to be substantially maintained, which also reduces operating costs. Further, since the loose scale is ground into relatively smaller pieces, use of the pump and grinder assembly 20 of the present invention permits the use of relatively smaller and less expensive, remotely operated drain valves, such as solenoid valve 118, which reduces overall capital costs.

Also, use of the pump and grinder assembly 20 significantly reduces the possibility of local hot spots and dry fires due to the periodic extraction of scale from within the housing 24 of the steam producing device 14. Accordingly, use of the pump and grinder assembly 20 of the present invention results in reduced chances of failure of the steam producing device 14 and therefore a longer service life and reduced capital costs associated with the steam producing device 14.

While the foregoing description has set forth the preferred embodiments of the present invention in particular detail, it must be understood that numerous modifications, substitutions and changes can be undertaken without departing from the true spirit and scope of the present invention as defined by the ensuing Claims. For instance, although the pump and grinder assembly 20 of the present invention has been illustrated for use with an atmospheric steam generator 14, the pump and grinder assembly of the present invention may also be used with other steam producing devices, including pressurized boilers. Although the pump and grinder assembly 20 has been illustrated for use with a steam producing device which uses an electrical heating device to transfer heat to the water included therein, the pump and grinder assembly 20 may be used in conjunction with a "gas-fired" steam producing device which typically uses a gas supply system and gas burners which heat air flowing within a firetube assembly disposed within an outer housing of the steam producing device. Heat is then transferred to the water contained between the firetube assembly and the outer housing. "Gas-fired" steam producing devices are known in the art. As discussed previously, while the motor 50 shown in the illustrative embodiment is an alternating current electric motor, direct current electric motors may be used instead as part of the pump and grinder assembly of the present invention. Also, pump and grinder assembly 20 has been shown to include a motor mount bracket 64 in the illustrative embodiment. However, it should be understood that a wide variety of motor mount brackets having configurations other than that illustrated with respect to bracket 64, may be included in the pump and grinder assembly of the present invention. Furthermore, it is possible that the motor mount bracket may be eliminated and replaced with a motor mounting housing. Also, as discussed previously, a wide variety of blades having other sizes, shapes and numbers may be used in lieu of blades 80 and 82, as well as additional numbers of blades 80 and 82, provided that the alternate blades are effective for pumping water and scale contained within the water out of the steam producing device and for grinding the scale into relatively smaller pieces. Further, the connecting member 122 may assume a wide variety of configurations, depending upon the configuration of the associated steam producing device. Also, in some circumstances, the connecting member 122 may be eliminated altogether. In this case, the housing 90 may be mounted directly on the associated steam producing device, with flange 98 being replaced by an appropriately configured mount flange. In still other embodiments, various other gaskets and seals may be used in lieu of those disclosed, provided that the function of sealing is maintained. Also, the coupling 112 and elbow 114 may be replaced with other drain devices effective for receiving water and scale passing through the drain port 110 formed in housing 90. Accordingly, the invention is therefore not limited to specific embodiments as described, but is only limited as defined by the following Claims.

What is claimed is:

1. A pump and grinder assembly for use with a steam producing device having a housing defining a water chamber and an aperture formed in the housing and communicating with the water chamber, said pump and grinder assembly comprising:

a motor having a rotatable output shaft;

a pump and grinder shaft coupled to said output shaft of said motor for rotation therewith;

a blade assembly having a plurality of blades, said blade assembly being secured to said pump and grinder shaft for rotation therewith;

a housing interconnected to a stationary portion of said motor, said housing defining a grinding chamber, said blades being disposed within said grinding chamber; and a drain port formed in said housing and conmmunicating with said grinding chamber, said drain port being disposed downstream of said blades;

said pump and grinder assembly being mountable on the steam producing device so that said grinding chamber communicates with the water chamber of the steam producing device, said pump and grinder assembly being operatively effective for pumping water and loose scale contained within the water out of the steam producing device and grinding the scale into relatively smaller pieces which may be discharged out of said drain port.

2. The pump and grinder assembly as recited in claim 1, further comprising:

a coupling and a set screw, said coupling and said set screw being effective for coupling said rotatable output shaft of said motor to said pump and grinder shaft.

3. The pump and grinder assembly as recited in claim 1, further comprising:

a hollow pipe coupling secured to said housing and disposed substantially concentrically with said drain port.

4. The pump and grinder assembly as recited in claim 1, wherein:

said blade assembly further includes a first blade-supporting portion and a second blade-supporting portion, said first and second blade-supporting portions being secured to said pump and grinder shaft for rotation therewith;

said plurality of blades includes a first plurality of blades and a second plurality of blades, said first plurality of blades being integral with said first blade-supporting portion, said second plurality blades being integral with said second blade-supporting portion.

5. The pump and grinder assembly as recited in claim 4, wherein:

said first blade-supporting portion is disposed forward or upstream of said second blade-supporting portion;

said first plurality of blades extend radially outwardly and forwardly or upstream from said first blade-supporting portion.

6. The pump and grinder assembly as recited in claim 5, wherein:

said second plurality of blades extend radially outwardly and rearwardly or downstream from said second blade-supporting portion.

7. The pump and grinder assembly as recited in claim 5, wherein:

said first plurality of blades comprises a pair of blades, each having a blade tip;

said blade tips of said pair of blades are separated by a first distance;

said downstream, proximal end of said hollow connecting member has a lateral or transverse internal dimension;

said lateral or transverse internal dimension of said downstream, proximal end of said hollow connecting member has a magnitude that is less than or equal to a magnitude of said first distance separating said tips of said pair of blades.

8. The pump and grinder assembly as recited in claim 7, wherein:

said lateral or transverse internal dimension of said downstream, proximal end of said hollow connecting member is an internal diameter.

9. The pump and grinder assembly as recited in claim 1, further comprising:

a motor mount bracket having a first end portion attached to said motor, said motor mount bracket having a second, opposite end portion;

a seal disposed between, and in sealing engagement with, said second, opposite end portion of said motor mount bracket and said housing, said seal, said motor mount bracket and said housing being secured to one another.

10. The pump and grinder assembly as recited in claim 9, further comprising:

a hollow connecting member having a downstream, proximal end secured to said housing of said pump and grinder assembly and an upstream, distal end terminating in a mount flange, said mount flange having a plurality of mount holes formed therein, said mount holes being effective for receiving fasteners to attach said pump and grinder assembly to the steam producing device;

said mount flange having a generally centrally disposed aperture formed therein, said aperture of said mount flange being substantially aligned with the aperture formed in the housing of the steam producing device when said pump and grinder assembly is attached to the steam producing device whereby an interior portion of said hollow connecting member and said grinding chamber are in communication with the water chamber of the steam producing device.

11. The pump and grinder assembly as recited in claim 10, further comprising:

a gasket having a plurality of mount holes equal in number to, and alignable with, said mount holes formed in said mount flange of said hollow connecting member, said gasket having a generally centrally disposed aperture substantially equal in size to said aperture formed in said mount flange of said hollow connecting member;

said gasket being disposed between said mount flange of said hollow connecting member and the steam producing device when said pump and grinder assembly is mounted on the steam producing device.

12. The pump and grinder assembly as recited in claim 9, further comprising:

a bearing having a flange portion and a substantially cylindrical portion integral with said flange portion, said substantially cylindrical portion extending longitudinally through said second, opposite end portion of said motor mount bracket, said flange portion of said bearing being disposed in contacting engagement with a first surface of said second, opposite end portion of said motor mount bracket which faces away from said motor.

13. The pump and grinder assembly as recited in claim 12, wherein:

said pump and grinder shaft longitudinally through said bearing and is rotatable within, and relative to, said bearing.

14. The pump and grinder assembly as recited in claim 13, further comprising:

an annular, elastomeric seal disposed longitudinally between said first substantially cylindrical portion of said pump and grinder shaft and said flange portion of said bearing;

said annular, elastomeric seal being disposed in surrounding relationship with said second substantially cylindrical portion of said pump and grinder shaft.

15. The pump and grinder assembly as recited in claim 12, further comprising:

a hollow coupling which is rotatably coupled to said pump and grinder shaft and said rotatable output shaft of said motor; and a gasket, said gasket being disposed in sealing engagement with said bearing and said hollow coupling.

16. The pump and grinder assembly as recited in claim 1, wherein:

said motor is an electric motor.

17. The pump and grinder assembly as recited in claim 16, wherein:

said electric motor is an alternating current electric motor.

18. The pump and grinder assembly as recited in claim 1, wherein:

said pump and grinder shaft includes a first substantially cylindrical portion having a first outside diameter, and a second substantially cylindrical portion having a second outside diameter;

said first and second substantially cylindrical portions are integral with one another;

said second outside diameter is less than said first outside diameter;

said blade assembly is secured to said first substantially cylindrical portion of said pump and grinder shaft.

19. The pump and grinder assembly as recited in claim 18, wherein:

said pump and grinder shaft includes a threaded portion integral with said second substantially cylindrical portion;

said threaded portion has external threads.

20. The pump and grinder assembly as recited in claim 19, further comprising:

a hollow coupling having a first end portion with internal threads, said internal threads being threadedly engaged with one of said pump and grinder shaft and said rotatable output shaft of said motor.

21. The pump and grinder assembly as recited in claim 20, further comprising:

a set screw, said set screw protruding through a hole formed in said hollow coupling and engaging the other of said pump and grinder shaft and said rotatable output shaft of said motor, whereby said hollow coupling and said set screw combine to rotatable couple said pump and grinder shaft to said rotatable output shaft of said motor.

22. The pump and grinder assembly as recited in claim 19, further comprising:

a hollow coupling having a first end portion with internal threads, said internal threads being threadedly engaged with said external threads of said threaded portion of said pump and grinder shaft.

23. The pump and grinder assembly as recited in claim 22, further comprising:

a set screw, said set protruding through a wall of said hollow coupling and engaging said rotatable output shaft of said motor, whereby said hollow coupling and said set screw combine to rotatably couple said pump and grinder shaft to said rotatable output shaft of said motor.

24. An assembly comprising:

a steam producing device; and a pump and grinder assembly mounted on the steam producing device;

said steam producing device including a housing defining a water chamber and a fill port formed in said housing and communicating with said water chamber, said fill port being effective for receiving water therethrough;

said steam producing device further including a drain port formed in said housing and communicating with said water chamber, and a heating device disposed at least partially within said water chamber, said heating device being effective for transferring heat to water contained within said water chamber during operation of said heating device;

said pump and grinder assembly being operatively effective for pumping water and scale suspended within the water out of the housing of the steam producing device and grinding the scale into relatively smaller pieces.

25. The pump and grinder assembly as recited in claim 24, wherein said pump and grinder assembly comprises:

a motor having a rotatable output shaft;

a pump and grinder shaft coupled to said output shaft of said motor for rotation therewith;

a blade assembly having a plurality of blades, said blade assembly being secured to said pump and grinder shaft for rotation therewith;

a housing interconnected to a stationary portion of said motor, said housing defining a grinding chamber, said blades being disposed within said grinding chamber; and a hollow drain port formed in said housing and communicating with said grinding chamber, said drain port being disposed downstream of said blades;

said pump and grinder assembly being mountable on the steam producing device so that said grinding chamber communicates with said water chamber of said steam producing device.

26. The pump and grinder assembly as recited in claim 24, wherein:

said housing of said steam producing device includes a bottom;

said fill port and said drain port of said steam producing device are longitudinally spaced apart.

* * * * *